US006439747B1

(12) United States Patent
Liu et al.

(10) Patent No.: US 6,439,747 B1
(45) Date of Patent: Aug. 27, 2002

(54) LAMP SHADE FOLDING STRUCTURE

(76) Inventors: Yi-Shun Liu, No.21, Chiao Chung 3, Panchiao (TW); Chin-Min Yang, 5F, No. 3 Alley 30 Lane 110, Jung Shing Rd., Hsichuh City, Taipei County (TW)

( * ) Notice: Subject to any disclaimer, the term of this patent is extended or adjusted under 35 U.S.C. 154(b) by 0 days.

(21) Appl. No.: 09/938,604

(22) Filed: Aug. 27, 2001

(51) Int. Cl.[7] ..... F21V 1/06

(52) U.S. Cl. ..... 362/352; 362/357; 362/358; 362/450; 362/434

(58) Field of Search ..... 362/351, 352, 362/355, 357, 358, 319, 356, 434, 450, 380; D26/118

(56) References Cited

U.S. PATENT DOCUMENTS 5,375,048 A * 12/1994 Barnes ..... 362/352
6,315,434 B1 * 11/2001 Long ..... 362/352
6,357,897 B1 * 3/2002 Shih ..... 362/352

* cited by examiner

*Primary Examiner*—Sandra O'Shea
*Assistant Examiner*—Hargobind S. Sawhney
(74) *Attorney, Agent, or Firm*—Bacon & Thomas, PLLC

(57) ABSTRACT

A lampshade folding structure to achieve minimum packing volume thus to reduce costs of packing material and transportation essentially comprised of a support frame to stretch up a soft shade between an upper and a lower rings; each ring provided with at least two pivoting devices so that when folded, both rings are folded into semi-circular shape and put on the same plane with the support frame removed to facilitate packaging, transportation, carriage and storage.

4 Claims, 3 Drawing Sheets

LAMP SHADE FOLDING STRUCTURE

BACKGROUND OF THE INVENTION (a) Field of the Invention

The present invention is related to a lamp-shape folding structure, and more particularly, to one that effectively reduces the dimension of the lampshade for saving transportation and packing material costs.

(b) Description of the Prior Art

Whereas a shade of a lamp is provided in a shape of a cape surrounding a bulb thus to keep the light not so irritating to one's eyes. Light may be present in various effects when emitting through the shade. As the shade usually has to expand for covering a certain space large enough to properly block the light source, it contains a mounting piece to adapt to the lighting fixture while the rest of the shade consumes a lot of space. Therefore, additional packing material and space are required during shipment, and higher custom clearance costs have to be paid.

For certain shades generally available in the market are made of soft and flexible materials restricted respectively at top and bottom an upper ring and a lower ring so that in transition, both rings are put together on a practically same plane to reduce shipping volume. However, both rings still claim a larger shipping space to prevent further reduction to the minimum shipping volume. Particularly, said shade, generally referred to a KD shade has its support frame for expanding the main portion of the shade connected to the lower ring. Therefore, when the support frame is put up side down during shipment, the support frame when lying flat must be maintained at a lateral length not greater than the diameter of the lower ring. Consequently, in the overall design of the KD shade, its diagonal length must not be greater than the diameter of the lower ring.

SUMMARY OF THE INVENTION

The primary purpose of the invention is to provide a lampshade having its upper and lower rings pivoted in conjunction with a support frame positioned between the upper and lower rings. The support frame together with the upper and lower rings stretch out the main portion of the lampshade made of soft and flexible material. Accordingly, upon disassembling the lamp shade, the support frame can be removed to place both rings on the same plane to reduce the height of the lamp shade while both rings are folded into a semi-circular shape, thus to achieve the minimum shipping space required and reduce the packing and shipping costs.

Another purpose of the present invention is to provide a lampshade that permits it to be knocked down to its most compact dimension to facilitate carrying and storage.

Another purpose yet of the present invention is to provide a lampshade that when the shade is not in use, its support frame can be removed so to eliminate the restriction on the overall dimension as the prior art of the present invention has been subject to.

BRIEF DESCRIPTION OF THE DRAWINGS

FIG. 3 is a view showing that the preferred embodiment of the present invention is folded in.

DETAILED DESCRIPTION OF THE PREFERRED EMBODIMENTS

Figure 1:
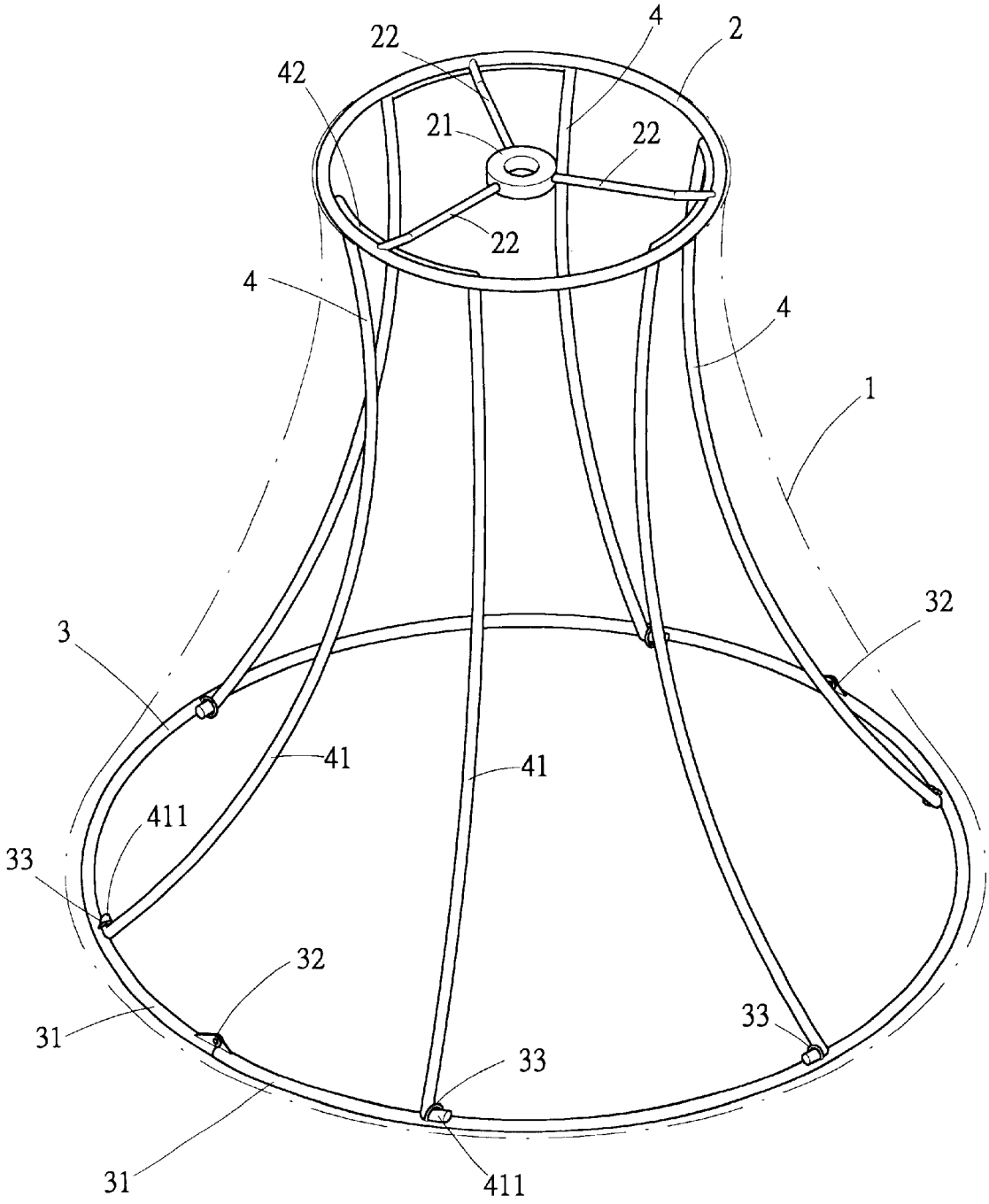
FIG. 1 is a view showing the appearance of a preferred embodiment of the present invention.

Referring to FIG. 1, a preferred embodiment of the present invention is essentially comprised of a soft shade (1) respectively fixed to its top and bottom an upper ring (2) and a lower ring (3), and a support frame (4) provided between said upper ring (2) and lower ring (3) to stretch the shade into a conic cape shape. A mounting hub (21) is provided at the center of the upper ring (1) to connect the shade (1) to a lighting fixture, and multiple links (22) are provided in radiation to connect between the hub (21) and the outer circumference of the upper ring (1) to give better structural strength.

Figure 2:
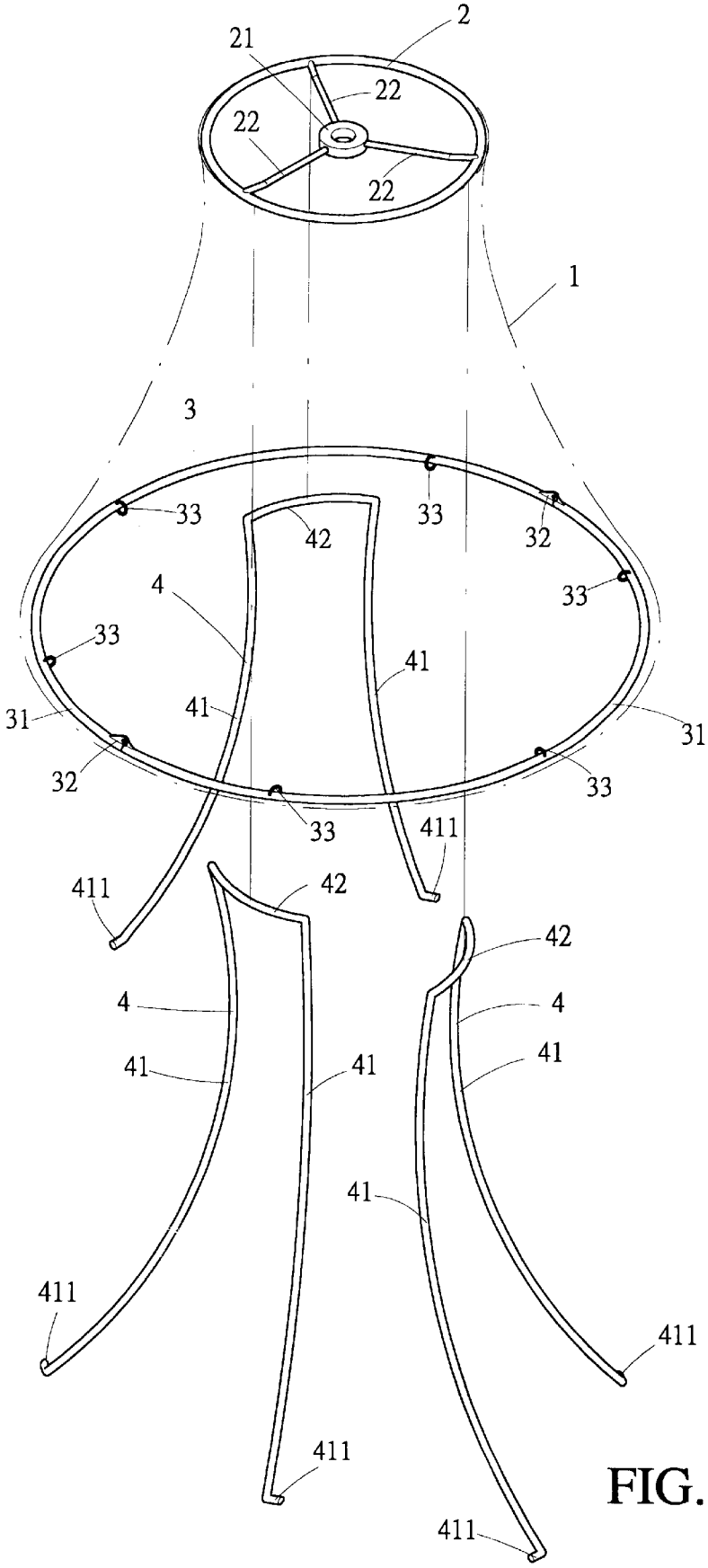
FIG. 2 is a schematic view showing an assembly of the preferred embodiment of the present invention.

As illustrated in FIG. 2, the support frame (4) is comprised of bent, flexible rods with its top forming a lateral section (42) to hold against the upper ring (1), then bent from both ends of said lateral section (42) downwards to form two straight sections (41) to push against the lower ring (2). A first stopper (33) and a second stopper (411) are respectively formed on the circumference (31) of the lower ring (3) and at both lower ends of the straight sections (41). In the preferred embodiment of the present invention, the second stopper (411) is directly formed by having the end of the straight section laterally bent for a proper length while the first stopper (33) is formed as a loop. Upon assembling, the second stopper (411) from the straight section (41) is directly inserted though the first stopper (33) of the lower ring (3) for the first stopper (33) to hold the second stopper (411) of the straight section (41) in position, and for the straight section (41) to actually stretch up the soft shade (1) by taking advantage of flexibility of the straight section (41).

Furthermore, the top of the support frame (4) can hold against each other with the links (22) mutually corresponding to the lateral section (42) and the upper ring (2). Within, the outwardly expanding support frame (4) works together with the pull force from the soft shade (1) to form a consistent binding force among the support frame (4), the upper ring (2) and the lower ring (3). When the shade is not used, simply bend the straight section (41) of the support frame (4) a little bit to disengage both of said first and second stoppers (33) (411) from each other, thus to remove the support frame (4) from the upper and the lower rings (2), (3), in turn, both rings (2) (3) are put together on the same plane by taking advantage of the softness of the shade (1) to reduce the height of the lampshade.

Figure 3:
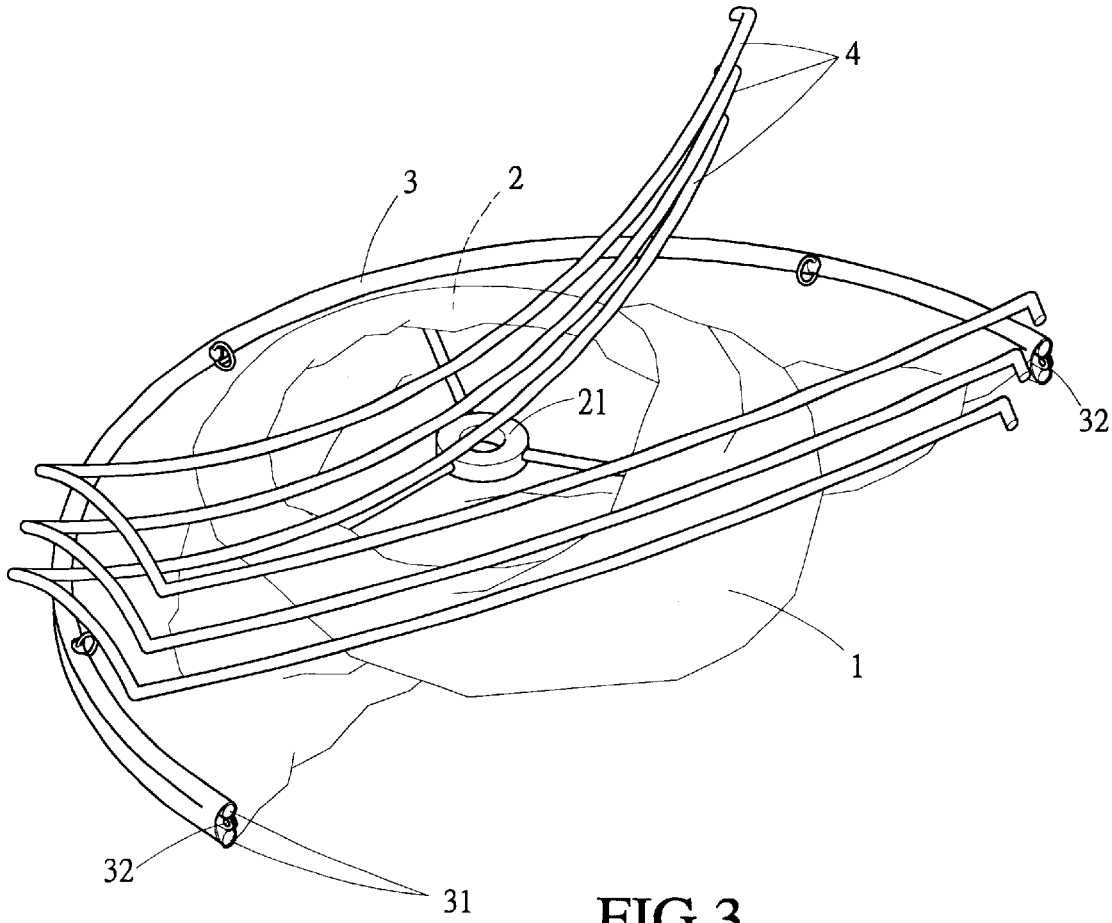

Now referring to FIG. 3, two pivoting devices (32) are provided on the circumference (31) at both extremes of any diameter of the lower ring (3) so to be folded into a semi-circular shape when the lampshade is not used or packed for shipment for further reduction of packing and transportation costs. If required, the similar pivoting devices can be also provided to the upper ring (1). Since the support frame (4) can be removed, it is not necessary to consider whether the length of the support frame (4) is greater than the width of the lower ring (3) as in the case of the design of the prior art of a KD lampshade.

As disclosed above, the present invention provides an improved structure to reduce packing and transportation costs for a lampshade by providing pivoting devices to both or either of the upper and lower rings so that either or both rings can be folded into semi-circular shape; and a support frame that can be removed from both rings to reduce the height of the lampshade. Therefore, this application for utility patent is duly filed accordingly.

We claim:

1. A lampshade folding structure, essentially comprised of a shade made of soft materials, fixed to its top and bottom respectively an upper ring and a lower ring; a support frame between said upper and lower rings for stretching up the shade into a conic cape shade; a mounting hub provided at the center of the upper ring to connect the shade to a lighting fixture, and multiple links provided in radiation to connect between the hub and the outer circumference of the upper ring (1) to give better structural strength; characterized by that:

said lower ring comprised of two semi-circular rings connected by at least two pivoting devices for the lampshade to reduce its dimension by removing the support frame, folding the lower ring into a semi-circular shape and putting both rings on the same plane, thus to reduce packing and transportation costs.

2. A lampshade folding structure as claimed in claim 1, wherein, said support frame is comprised of flexible rods each bent into a shape having a top lateral section holding against the upper ring and two straight sections extending downward respectively from both ends of said top lateral section, two or more than two first and second stoppers are provided respectively on the circumference of the lower ring and on lower ends of the straight sections for the first stoppers to hold the second stoppers in position; thus to form a consistent binding force among both rings and the support frame when the support frame stretches outwardly in conjunction with the pull force exercised by the soft shade; and the support frame is removed with both rings put on same plane and the lower ring folded into a semi-circular from to achieve the minimum shipping space for reduction of packing and transportation costs.

3. A lampshade folding structure as claimed in claim 1, wherein, said second stopper on end of the straight section being directly extending and laterally bent for a proper length; and said first stopper on the lower ring is formed as a loop to receive insertion by the second stopper.

4. A lampshade folding structure as claimed in claim 1, wherein, said upper ring is also comprised of two semi-circular rings connected by at least two pivoting devices.

* * * * *

US006439747C1

(12) EX PARTE REEXAMINATION CERTIFICATE (5419th)

United States Patent

Liu et al.

(10) Number: US 6,439,747 C1

(45) Certificate Issued: Jun. 20, 2006

(54) LAMP SHADE FOLDING STRUCTURE

(75) Inventors: Yi-Shun Liu, No.21, Chiao Chung 3, Panchiao (TW); Chin-Min Yang, 5F, No. 3 Alley 30 Lane 110, Jung Shing Rd., Hsichuh City, Taipei County (TW)

(73) Assignees: Yi-Shun Liu, Panchaio (TW); Chin-Min Yang, Hsiehuh (TW)

Reexamination Request:
No. 90/006,648, May 28, 2003

Reexamination Certificate for:

| | |
|---|---|
| Patent No.: | **6,439,747** |
| Issued: | **Aug. 27, 2002** |
| Appl. No.: | **09/938,604** |
| Filed: | **Aug. 27, 2001** |

(51) Int. Cl.
*F21V 1/06* (2006.01)

(52) U.S. Cl. ..... 362/352; 362/357; 362/358; 362/450; 362/434

(58) Field of Classification Search ..... 362/352, 362/353, 354, 355, 356, 357, 358, 450, 434
See application file for complete search history.

(56) References Cited

U.S. PATENT DOCUMENTS

| | | | | |
|---|---|---|---|---|
| 6,443,600 | B1 * | 9/2002 | Wu | 362/352 |
| 6,517,220 | B1 * | 2/2003 | Wu | 362/352 |
| 6,523,981 | B1 * | 2/2003 | Wu | 362/352 |
| 6,540,383 | B1 * | 4/2003 | Wu | 362/450 |
| 6,709,134 | B1 * | 3/2004 | Wu | 362/352 |

* cited by examiner

*Primary Examiner*—John Anthony Ward

(57) ABSTRACT

A lampshade folding structure to achieve minimum packing volume thus to reduce costs of packing material and transportation essentially comprised of a support frame to stretch up a soft shade between an upper and a lower rings; each ring provided with at least two pivoting devices so that when folded, both rings are folded into semi-circular shape and put on the same plane with the support frame removed to facilitate packaging, transportation, carriage and storage.

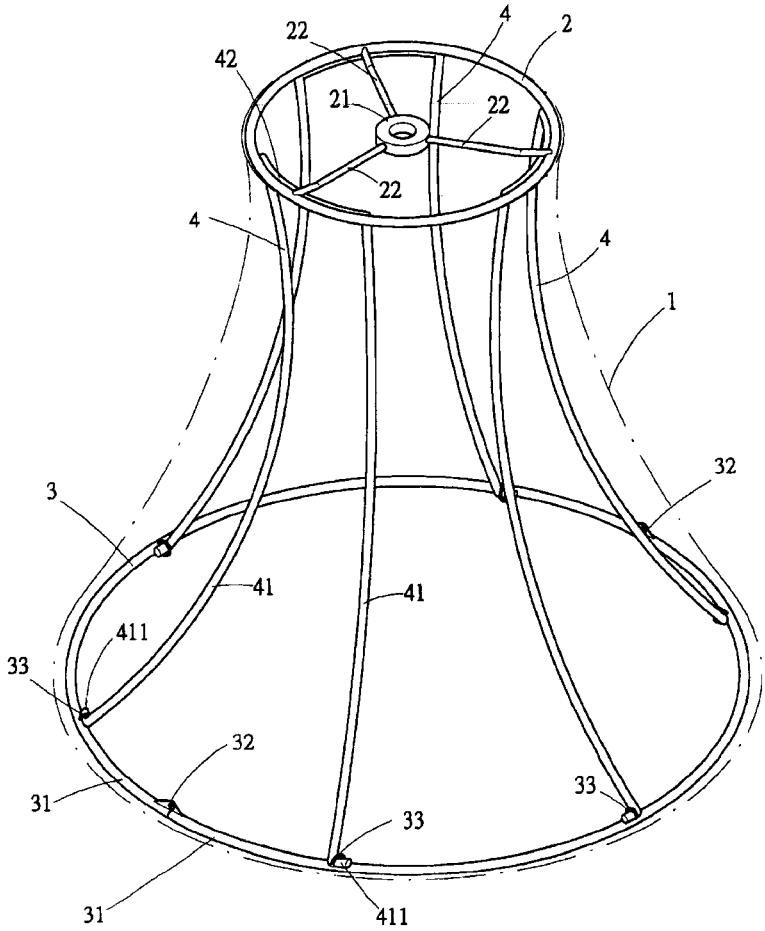

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4 are cancelled.

* * * * *